US009167666B1

(12) United States Patent
Billheimer et al.

(10) Patent No.: US 9,167,666 B1
(45) Date of Patent: Oct. 20, 2015

(54) LIGHT CONTROL UNIT WITH DETACHABLE ELECTRICALLY COMMUNICATIVE FACEPLATE

(71) Applicant: Ketra, Inc., Austin, TX (US)

(72) Inventors: Jeremy G. Billheimer, Austin, TX (US); Tomas J. Mollnow, Austin, TX (US); John P. Michalko, Austin, TX (US); Michael K. Hart, Austin, TX (US)

(73) Assignee: Ketra, Inc., Austin, TX (US)

( * ) Notice: Subject to any disclaimer, the term of this patent is extended or adjusted under 35 U.S.C. 154(b) by 0 days.

(21) Appl. No.: 14/293,104

(22) Filed: Jun. 2, 2014

(51) Int. Cl.
*H05B 37/02* (2006.01)

(52) U.S. Cl.
CPC ..... *H05B 37/02* (2013.01)

(58) Field of Classification Search
CPC ..... H05B 37/02
USPC ..... 315/153
See application file for complete search history.

(56) References Cited

U.S. PATENT DOCUMENTS

| | | | | |
|---|---|---|---|---|
| 4,402,090 | A | 8/1983 | Gfeller et al. | |
| 5,657,145 | A | 8/1997 | Smith | |
| 6,333,605 | B1 | 12/2001 | Grouev et al. | |
| 6,965,205 | B2 | 11/2005 | Piepgras et al. | |
| 7,071,414 | B2 | 7/2006 | Kim | |
| 7,072,587 | B2 | 7/2006 | Dietz et al. | |
| 8,247,693 | B2 | 8/2012 | Gober | |
| 8,704,666 | B2 | 4/2014 | Baker, Jr. | |
| 2003/0103413 | A1 | 6/2003 | Jacobi, Jr. et al. | |
| 2003/0114133 | A1* | 6/2003 | Enners | 455/344 |
| 2005/0169643 | A1 | 8/2005 | Franklin | |
| 2005/0265731 | A1 | 12/2005 | Keum et al. | |
| 2008/0120559 | A1 | 5/2008 | Yee | |
| 2008/0136334 | A1 | 6/2008 | Robinson et al. | |
| 2008/0253766 | A1 | 10/2008 | Yu et al. | |
| 2008/0265799 | A1 | 10/2008 | Sibert | |
| 2008/0304833 | A1 | 12/2008 | Zheng | |
| 2009/0020307 | A1 | 1/2009 | Roach, Jr. | |
| 2009/0026978 | A1 | 1/2009 | Robinson | |
| 2012/0001567 | A1 | 1/2012 | Knapp et al. | |
| 2013/0257315 | A1* | 10/2013 | Restrepo et al. | 315/362 |
| 2014/0077707 | A1* | 3/2014 | Restrepo | 315/158 |

FOREIGN PATENT DOCUMENTS

| | | |
|---|---|---|
| EP | 0456462 | 11/1991 |
| WO | 2010/124315 | 11/2010 |

* cited by examiner

*Primary Examiner* — Don Le
(74) *Attorney, Agent, or Firm* — Mollie E. Lettang; Kevin L. Daffer; Daffer McDaniel LLP

(57) ABSTRACT

Lighting systems are provided which include a remote set of light fixtures communicably coupled to a base and a faceplate detachably mounted to the base such that electrical contacts of the faceplate are coupled to respective electrical contacts of the base. The faceplate includes one or more user input interfaces and/or one or more environmental sensors. In some cases, the base and faceplate are each programmed to facilitate communication between the base and the faceplate to independently control each of the light fixtures based on input to the user input interface(s) and/or the environmental sensor(s). In addition or alternatively, either the base or the faceplate is programmed to auto-configure hardware and/or software of the faceplate and the base, respectively. In some cases, the base may be programmed to individually auto-configure differing hardware and/or software of a plurality of different faceplates when they are respectively coupled to the base.

25 Claims, 4 Drawing Sheets

LIGHT CONTROL UNIT WITH DETACHABLE ELECTRICALLY COMMUNICATIVE FACEPLATE

BACKGROUND OF THE INVENTION

1. Field of the Invention

This invention generally relates to lighting systems and, more specifically, to devices for controlling illumination of a set of remote light fixtures.

2. Description of the Related Art

The following descriptions and examples are not admitted to be prior art by virtue of their inclusion within this section.

Control units for varying the illumination of light fixtures and/or managing the illumination of multiple light fixtures are becoming increasingly complex and variable with the advent of environmental sensing and automation integrated within control units. The control units are generally remote from the light fixtures and, in many cases, are wired to the fixtures via electrical connections within standard electrical junction boxes in walls. In addition, many control units are programmable and include wireless functionality. Due to their complexity, installation of advanced control units (i.e., connection to a set of lighting fixtures) often requires the skill of an electrician and/or a field representative, which is costly and generally time consuming. As a consequence, consumers are often deterred from purchasing control units with alternative and/or new features.

Accordingly, it would be desirable to develop a lighting control device which may be easily installed by a consumer. It would be further beneficial to develop a lighting control device which offers interchangeable light control features.

SUMMARY OF THE INVENTION

Lighting systems and components thereof are provided for controlling illumination of a remote set of lighting fixtures. The follow description of various embodiments of systems and components is not to be construed in any way as limiting the subject matter of the appended claims.

Embodiments of systems include a base, a faceplate detachably mounted to the base such that power and data electrical contacts of the faceplate are coupled to respective power and data electrical contacts of the base, and a remote set of light fixtures communicably coupled to the base. The faceplate includes one or more user input interfaces and/or one or more environmental sensors. In addition, the base and the faceplate each include memory and a processor, and wherein the respective memories of the base and the faceplate each include respective processor-executable program instructions to facilitate electrical communication between the base and the faceplate to independently control each of the remote set of light fixtures based on input to the user input interface(s) and/or the environmental sensor(s).

Embodiments of a base component of a light control system includes power and data electrical contacts arranged to respectively couple to power and data electrical contacts of a plurality of different faceplates which when individually connected to the base component collect and send information to the base component to control one or more remote light fixtures of the light control system. The base component includes a processor as well as memory including program instructions executable by the processor to individually auto-configure differing hardware and/or software of the plurality of different faceplates when they are respectively coupled to the base component.

Embodiments of a detachable faceplate for a light control system includes a user input interface disposed on a first side of the detachable faceplate as well as power and data electrical contacts disposed on a second opposing side of the faceplate. The detachable faceplate further includes a processor as well as memory having program instructions executable by the processor to auto-configure hardware and/or software of a base component of the light control system.

BRIEF DESCRIPTION OF THE DRAWINGS

For a more complete understanding of the present invention, and the advantages thereof, reference is now made to the following descriptions taken in conjunction with the accompanying drawings, in which.

Figure 1:
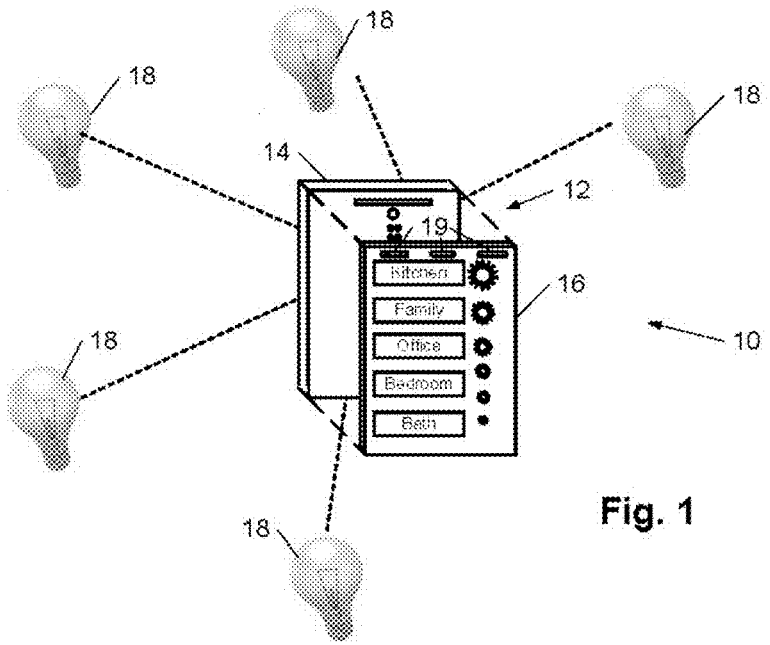
FIG. 1 is a schematic diagram of a lighting system for controlling illumination of a remote set of lighting fixtures.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Turning to the drawings, FIG. 1 depicts a schematic diagram of lighting system 10 having central control unit 12 for controlling illumination of a remote set of light fixtures 18. As shown, central control unit 12 includes a backend base 14 communicably coupled to the light fixtures 18 and further includes faceplate 16 detachably mounted to backend base 14. Dotted lines are used in FIG. 1 to denote communication links between backend base 14 and light fixtures 18. The communication links may be wired or wireless. Dotted lines are also used to emphasize the detachability of faceplate 16 to backend base 14. Functionalities and example structural configurations of backend base 14, faceplate 16 and light fixtures 18 are described in more detail below. As noted below, alternative configurations of backend base 14, faceplate 16 and light fixtures 18 may be considered relative to those depicted in FIGS. 1-10 and, thus, the lighting systems described herein as well as the backend bases, faceplates and light fixtures described herein are not limited to the depictions in FIGS. 1-10. Furthermore, it is noted that the lighting systems, backend bases, faceplates and light fixtures described herein as a whole or particular features thereof are not limited to the scale of any of FIGS. 1-10.

Although incandescent light bulbs are shown in FIG. 1 for remote set of light fixtures 18, light fixtures 18 need not be restricted to such a lamp type. In particular, light fixtures 18 may include any type of lamp, including but not limited to incandescent lamps, fluorescent lamps, and light-emitting diodes. In addition, light fixtures 18 may include any type of light fixture, including free-standing fixtures, surface-mounted fixtures and recessed fixtures. Furthermore, remote set of light fixtures 18 may include any number of light fixtures, including a single light fixture or multiple light fixtures. In the latter embodiments, some or all of the multiple light fixtures may be of the same type or may be of a different type and/or include the same type of lamp or different types of lamps.

As noted above, faceplate 16 is detachably mounted to backend base 14. More specifically, faceplate 16 is detachably mounted to backend base 14 such that power and data electrical contacts on the backside of the faceplate are coupled to respective power and data electrical contacts on the front side of backend base 14. Central control unit 12 may include any means for detachably mounting or securing faceplate 16 to backend base 14, including but not limited to magnets on both components, reusable adhesive on either or both components, suction cups on either or both components, and any type of fastener, such as but not limited to screws, nuts and bolts, clasps on either or both components, and hook and loop fasteners. In any case, backend base 14 may be mounted on a support structure and, thus, backend base 14 may include a means for mounting or securing itself to a support structure, including but not limited to magnets, adhesive, suction cups, and any type of fastener, such as but not limited to screws, nuts and bolts, clasps, and hook and loop fasteners. In some cases, it may be advantageous to mount backend base 14 to a wall and, in some embodiments, it may be advantageous for backend base 14 to be dimensionally configured to at least partially nest within an electrical junction box in a wall.

As shown in FIG. 1, faceplate 16 may include a visual display denoting different rooms in which light fixtures 18 may reside and the brightness level associated with one or more of the light fixtures (e.g., by a display of vertically arranged suns increasing in size from the bottom of the faceplate to the top of the faceplate as shown in FIG. 1). It is noted that the items displayed on faceplate 16 in FIG. 1 are merely examples of what may be displayed thereon. Several additional or alternative items may be displayed depending on the design specifications of faceplate 16. For example, central control unit 12 may, in some cases, be used to control a set of light fixtures in a single room. In such cases, different areas or key features of the room that are associated with different light fixtures therein may be displayed. In other embodiments, central control unit 12 may be used to control a set of light fixtures throughout a multi-story building. In such cases, each floor of the building may be displayed on faceplate 16. In yet other embodiments, different areas, rooms or floors associated with light fixtures 18 may not be displayed on faceplate 16. In addition, faceplate 16 need not display or be limited in displaying brightness level associated with one or more of the light fixtures. Other aspects of lighting that may be of interest to a user may be additionally or alternatively displayed, including but not limited to color and mood settings. In any case, the visual display on faceplate 16 may in some cases be lighted. An example of a lighted visual display is one which includes a screen print of words, symbols and/or differentiating borders on the transparent front cover of the faceplate and the faceplate further including optical components for illuminating different portions of the transparent front cover. An example of optical components which may be used in faceplate 16 is described in more detail below in reference to FIGS. 9 and 10.

In addition to having a visual display, faceplate 16 may include one or more user input interfaces on its front side such that a user of lighting system 10 may control the illumination of light fixtures 18 via central control unit 12. In particular, as set forth in more detail below, faceplate 16 may be configured to pass signals indicative of input to its one or more user input interfaces to backend base 14, which in turn sends signals to control the illumination of applicable light fixtures. The user input interface(s) may be any user interfaces known to those skilled in the art, including but not limited to toggle switches, buttons and touch sensors. In some embodiments, the user input interface(s) may be integrated within a portion of the visual display. For example, each portion of the visual display on faceplate 16 denoting the different rooms in which light fixtures may reside may include an individual touch sensor such that the lighting fixture for a particular room may be controlled. In addition or alternatively, the visual display on faceplate 16 may include a touch-enabled swiping technology along the display of vertically arranged suns such that the brightness level of one or more light fixtures 18 may be controlled. It is noted that several other integration configurations of user input interface(s) may be considered for the visual display of faceplate 16 and, thus, the lighting systems and faceplates described herein are not limited to the aforementioned examples.

In some embodiments, faceplate 16 may additionally or alternatively include one or more environmental sensors 19 for detecting and/or collecting ambient information from an area in which central control unit 12 is arranged or, more specifically, an area in which the front side of faceplate 16 is exposed. In such cases, control of light fixtures 18 may be constantly, episodically, periodically or occasionally based on information received by the one or more environmental sensors and transmitted to backend base 14. Control of light fixtures 18 by the one or more environmental sensors may be in addition or alternative to control of the light fixtures by input to the one or more user input interfaces. In some embodiments, light fixtures 18 may be controlled based on input by the one or more environmental sensors, but such control may be superseded by input to the one or more user input interfaces.

In any case, examples of environmental sensor(s) that may be disposed in faceplate 16 include but are not limited to proximity sensors, motion sensors, light sensors and temperature sensors. In general, the term "environmental sensor" refers to a device which measures a physical quantity in an ambient in which the device is arranged and converts the measured quantity to a readable signal for a control instrument. In some embodiments, faceplate 16 may be void of environmental sensors. In such cases, control of light fixtures 18 may be solely based on input to the one or more user input interfaces or solely on a combination of input to the one or more user input interfaces and default settings of the light fixtures. In yet other embodiments, faceplate 16 may be void of a user input interface and control of light fixtures 18 may be solely based on input to one or more environmental sensors of the faceplate or solely on a combination of input to the one or more environmental sensors and default settings of the light fixtures.

Regardless of whether faceplate 16 includes user input interface(s) or environmental sensor(s), faceplate 16 includes power and data electrical contacts arranged to respectively couple to power and data electrical contacts of backend base 14 such that signals regarding input received via the user input interface(s) or environmental sensor(s) may be sent to backend base 14 to control the illumination of light fixtures 18. As noted above, backend base 14 is communicably coupled to the light fixtures 18 and the communication links may be wired or wireless. As used herein, the term "electrical contact" is an electrical conductor of a device configured to mate with an electrical conductor of another device for joining electrical circuits of the distinct components. In some cases, electrical contacts of backend base 14 and faceplate 16 may be male connectors and female connectors, respectively or vice versa. In other embodiments, however, it may be advantageous for the electrical contacts of backend base 14 and faceplate 16 to be pins and contact pads to provide a quick and easy coupling of faceplate 16 to backend base 14. For example, in some cases, faceplate 16 may include power and data electrical contact pads arranged to respectively couple to power and data electrical pins of backend base 14. In other embodiments, faceplate 16 may include power and data electrical pins arranged to respectively couple to power and data electrical contact pads of backend base 14. In yet other cases, faceplate 16 and backend base 14 may each include a combination of electrical contact pads and pins arranged to respectively couple to opposing electrical pins and contact pads of the other component.

Figure 2:
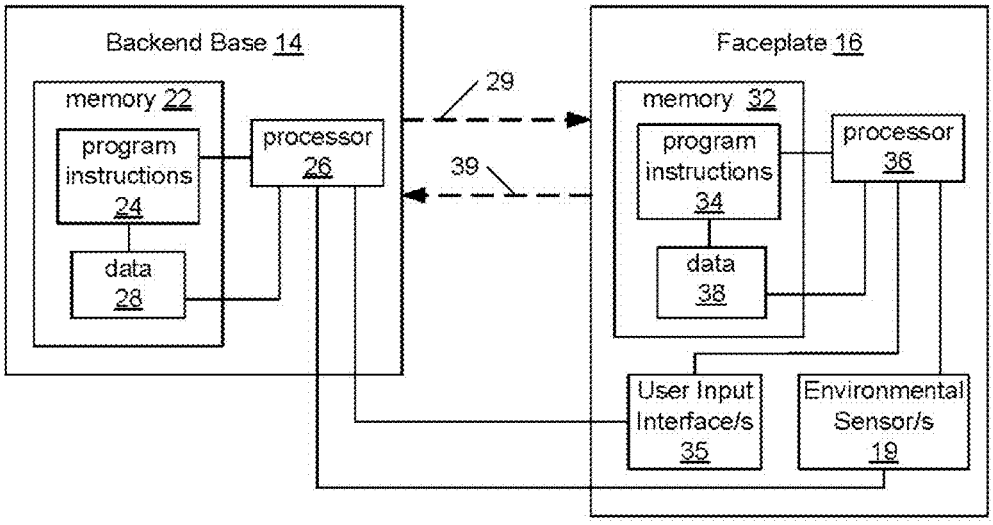
FIG. 2 is a schematic diagram of inner components of a backend base and a faceplate of a control unit of the light system depicted in FIG. 1.

Turning to FIG. 2, a schematic diagram of inner components of backend base 14 and faceplate 16 is shown. More specifically, backend base 14 and faceplate 16 are shown each including a processor and memory including program instructions and data. In general, program instructions 24 and 34 are respectively stored in memories 22 and 32 and are executable by respective processors 26 and 36. Storage of data 28 and 38 are individually optional and may be accessed by either or both of the respective program instructions and processors of backend base 14 and faceplate 16. Data 28 and 38 may be temporarily stored information, permanently stored information or a combination thereof. Examples of information for data 28 and/or 38 include but are not limited to input received from user input interface(s) 35 and/or environmental sensor(s) 19 of faceplate 16, configuration data for faceplate 16 and/or backend base 14, default settings for faceplate 16 and/or backend base 14, as well as default settings for light fixtures 18. In alternative embodiments, input received from user input interface(s) 35 and/or environmental sensor(s) 19 may not be saved, configuration data and/or default settings for faceplate 16 and/or backend base 14 may be integrated within program instructions 24 and/or 34, and/or default settings for light fixtures 18 may be stored at the individual light fixtures.

In general, data 28 and/or 38 may be stored on the same memory device or a different memory device than that which stores program instructions 24 and 34, respectively. As used herein, the term "memory" refers to one or more physical devices used to store program instructions or data for use in an electronic device. As such, the depiction of memories 22 and 24 in FIG. 2 can each represent a single memory device or multiple memory devices. In cases in which memory 22 and/or 24 includes multiple memory devices, the multiple memory devices may be the same type or different types. Memories 22 and 24 may be volatile or non-volatile. Examples of memory which may be used for either of memories 22 and 24 include but are not limited read-only memory, a random access memory, and flash memory. The term "program instructions" as used herein refers to commands within a program which are configured to perform a particular function, such as receiving input, recording receipts of signals, and processing input. Program instructions may be implemented in any of various ways, including procedure-based techniques, component-based techniques, and/or object-oriented techniques, among others. For example, the program instructions may be implemented using ActiveX controls, C++ objects, JavaBeans, Microsoft Foundation Classes ("MFC"), or other technologies or methodologies, as desired. Program instructions implementing the processes described herein may be transmitted over on a carrier medium such as a wire, cable, or wireless transmission link.

In some cases, program instructions 24 and 34 may each include program instructions to facilitate electrical communication between backend base 14 and faceplate 16 to independently and/or collectively control the illumination of remote set of light fixtures 18 based on input to one or more user input interfaces 35 and/or one or more environmental sensors 19. More specifically, program instructions 34 may include program instructions executable by processor 36 to receive and, in some embodiments, process information from input user interface(s) 35 and/or environmental sensor(s) 19 and then send the received or processed information to backend base 14. In addition, program instructions 24 may include program instructions executable by processor 26 to receive and, in some cases, process the information sent from program instructions 34 and then generate and send signals to control the illumination of light fixtures 18 based on the information. In such scenarios, algorithm(s) and/or protocol(s) used to process the information may be integrated into either or both of program instructions 24 and 34.

In addition or alternative to facilitating electrical communication between backend base 14 and faceplate 16, program instructions 24 and 34 may include program instructions which are specific to the individual operations of backend base 14 and faceplate 16, respectively, without being dependent on receiving signals from the program instructions of the other component. For example, program instructions 34 may include program instructions to constantly, episodically, periodically or occasionally illuminate portions or all of the visual display of faceplate 16 without receipt of signals from program instructions 24. In addition or alternatively, program instructions 24 may include program instructions to independently and/or collectively control illumination of light fixtures 18 based on information sent directly from input user interface(s) 35 and/or environmental sensor(s) 19. In particular, program instructions 24 may include program instructions executable by processor 26 to receive information directly from input user interface(s) 35 and/or environmental sensor(s) 19 and process the information in accordance with algorithm(s) or protocol(s) for controlling illumination of light fixtures 18. In such scenarios, faceplate 16 may include control circuitry to transfer information generated and/or received by its user input interface(s) and/or environmental sensor(s) directly to its electrical contacts rather than routing such information to program instructions 34 and having program instructions 34 process the information and/or generate a signal to send to program instructions 24 which is indicative of the information. In this manner, program instructions 34 may not, in some cases, include program instructions to process information from input user interface(s) 35 and/or environmental sensor(s) 19. To that regard, program instructions 34 may not, in some cases, include program instructions to aid in controlling the illumination of light fixtures 18. Moreover, program instructions 34 may not, in some embodiments, include program instructions which transmits and/or receives information from backend base 14.

Regardless of where the information from input user interface(s) 35 and/or environmental sensor(s) 19 are processed, the signals generated to control illumination of light fixtures 18 may, in some cases, be based on a single input from user input interface(s) 35 and/or a single input from environmental sensor(s) 19. In other embodiments, the signals generated to control the illumination of one or more light fixtures 18 may be based on a combination of input from user input interface(s) 35 and/or environmental sensor(s) 19. In some cases, program instructions 24 may include program instructions to occasionally or episodically (e.g., in response to input from user input interface(s) 35 and/or environmental sensor(s) 19) generate signals to control the illumination of one or more light fixtures 18 according to default settings of the light fixtures. As noted above, default settings for light fixtures 18 may be stored in data 28, data 38 or with the light fixtures themselves.

Regardless of whether program instructions 24 and 34 are used for separate operation of backend base 14 and faceplate 16 and/or are used to facilitate communication therebetween for control of illumination of light fixtures 18, one of program instructions 24 and 34 may include program instructions to auto-configure hardware and/or software of faceplate 16 or backend base 14, respectively. As used herein, the term "auto-configure" refers to automatically setting hardware and defining values of software parameters of an electronic device without manual intervention. The term "plug and play" is referenced herein to have the same meaning and, thus, the terms may be used interchangeably herein. The ability of program instructions 24 or 34 to auto-configure faceplate 16 and backend base 14, respectively, may be particularly advantageous in embodiments in which a plurality of different faceplates may be interchangeably used in a lighting control system as described in more detail below.

Figure 3:
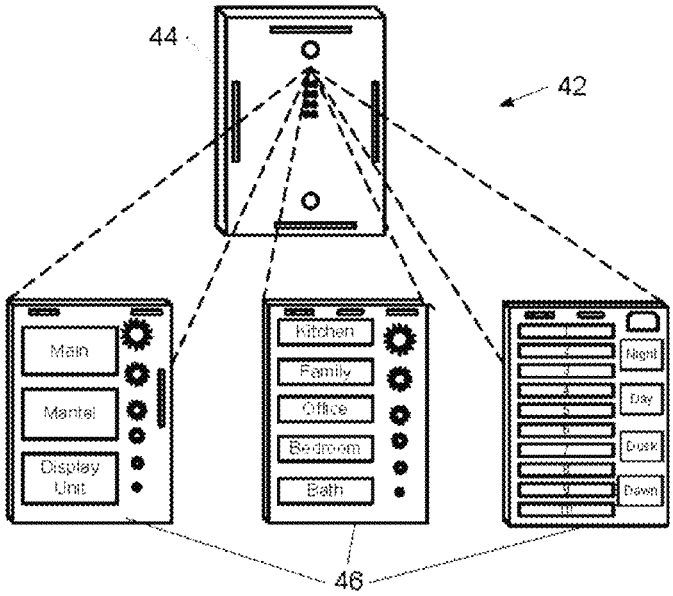
FIG. 3 is a schematic diagram of a lighting control unit having a single backend base and a plurality of interchangeable faceplates.

A schematic diagram of an example light control unit having a single backend base and a plurality of interchangeable faceplates in illustrated in FIG. 3. In particular, FIG. 3 illustrates central light control unit 42 including backend base 44 and a plurality of interchangeable faceplates 46. In general, the components and structural configuration of backend base 44 and interchangeable faceplates 46 may be similar to those described for backend base 14 and faceplate 16 in reference to FIGS. 1 and 2, with the exception that interchangeable faceplates 46 have different features and/or functions and, therefore, have different software and/or hardware (such as a different compilation of user input interface(s) and/or environmental sensor(s)). For instance, as illustrated in FIG. 3, interchangeable faceplates 46 may optionally include different visual displays. The visual displays shown in FIG. 3 for interchangeable faceplates 46 are examples and, thus, the systems and faceplates described herein should not be limited to the depiction of FIG. 3. In any case, each of the interchangeable faceplates 46 includes power and data electrical contacts arranged to respectively couple to power and data electrical contacts of backend base 44. Such commonality regarding the arrangement of the electrical contacts and the ability of the backend base or the faceplates to auto-configure the other as described below lends to the interchangeability of the faceplates. It is noted that central light control unit 42 may have any plurality of interchangeable faceplates and, thus, is not limited to having three as depicted in FIG. 3.

Due to the different functionalities and/or features of interchangeable faceplates 46, the hardware and software of either backend base 44 and/or interchangeable faceplates 46 needs to be configured with the respective hardware set-up and/or software of the opposing device. In general, it is advantageous to automate this process to minimize or eliminate steps a user needs to take to utilize different faceplates within central light control unit 42. Thus, backend base 44 and/or interchangeable faceplates 46 may, in some embodiments, include program instructions to auto-configure the opposing device. In some cases, it may be advantageous to have backend base 44 include processor executable program instructions to individually auto-configure differing hardware and/or software of the plurality of different faceplates 46. In particular, configuration software can be relatively complex and, thus, it will be more time and cost efficient to dispose such software on a common component of a system, such as backend base 44, rather than on each of a plurality of interchangeable components, such as faceplates 46. In other embodiments, however, it may be advantageous for each of interchangeable faceplates 46 to have processor executable program instructions to auto-configure hardware and/or software of backend base 44. In such cases, faceplates 46 do not need to have electronic identification tags as described below. In addition, backend base 44, in such embodiments, does not need to be updated when a new faceplate product is developed for the backend base.

As noted above, in embodiments in which backend base 44 includes processor executable program instructions to individually auto-configure differing hardware and/or software of the plurality of different faceplates 46, each of faceplates 46 may include a different electronic identification tag. In such cases, backend base 44 may include a database of the electronic identification tags of all interchangeable faceplates which may be used in conjunction with the backend base. In addition, backend base 44 may include processor-executable program instructions to detect the different electronic identification tags and further include program instructions for accessing different auto-configuration program instructions associated with the different electronic identification tags. More specifically, backend base 44 may include program instructions for sending specific auto-configuration program instructions to a faceplate mounted thereon upon detecting and reconciling an electronic tag of the faceplate with the database of electronic identification tags stored in backend base 44.

The electronic identification tags may be representative of the functionalities and features of each of the respective faceplates 46 and, thus, may be generally product specific (the term "product" used in such a reference refers to the each of faceplates 46 being a different consumer good and, thus, a particular product may be fabricated to have the same electronic identification tag). The term "electronic identification tag" as used herein refers to an electronic mechanism used to distinguish and identify a particular object or type of objects. Examples of electronic identification tags which may be suitable for the faceplates described herein include but are not limited to radio-frequency identification systems, bokode systems, and control circuitry. Faceplates 46 may be configured to transmit their electronic identification tag upon coupling to backend base 44 or backend base 44 may be configured to query a faceplate for its electronic identification tag upon its coupling thereto. In either case, it is noted that electronic identification tags are not exclusive to central light control units having a plurality of interchangeable faceplates. In addition, electronic identification tags are not exclusive to light control units wherein the backend base includes program instructions to auto-configure a plurality of interchangeable faceplates. Rather, any of the faceplates described herein may include an electronic identification tag, including those which serve as the sole faceplate used in a light control unit and those which include program instructions to auto-configure a backend base of a light control unit.

In yet other cases, a faceplate may not include an electronic identification tag, particularly if the faceplate includes program instructions for auto-configuring a backend base (i.e., rather than the other way around) or if the faceplate is the only faceplate product which may be used in conjunction with a particular backend base. Further to the latter of such embodiments, the faceplate and the backend base may be optionally void of program instructions for auto-configuring the opposing device since the configuration of the faceplate to which the backend base communicates with is constant. In such cases, the faceplate and backend base may start their respective operations and, in some embodiments, bi-directional communication upon coupling the components together without any auto-configuration between them. It is noted that if a new faceplate product is developed for a light control unit which is configured to function with a single faceplate (versus a plurality of interchangeable faceplates), the backend base may be updated with the configuration of the new faceplate product. As described in more detail below in reference to FIG. 4, a backend base may include a computer service port to accommodate such an option.

Figure 4:
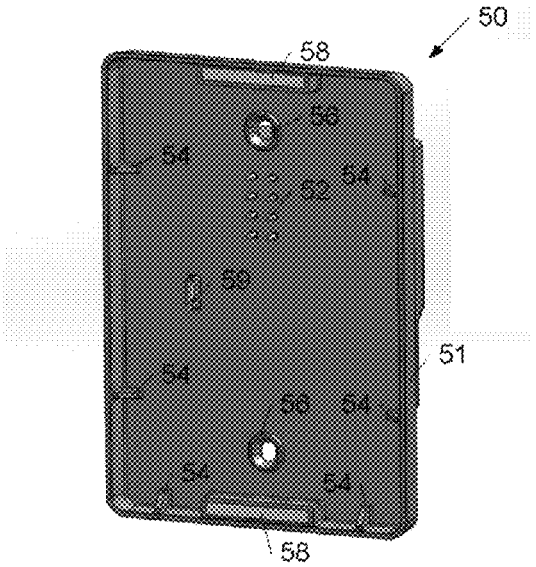
FIG. 4 is a front perspective view of a backend base of a light control unit used to control illumination of a remote set of lighting fixtures.
Figure 5:
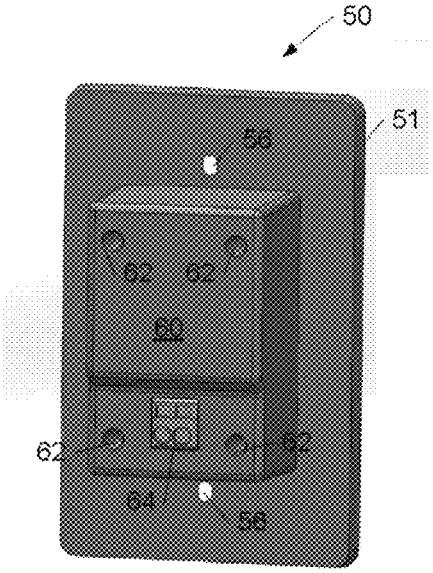
FIG. 5 is a back perspective view of the backend base depicted in FIG. 4.
Figure 6:
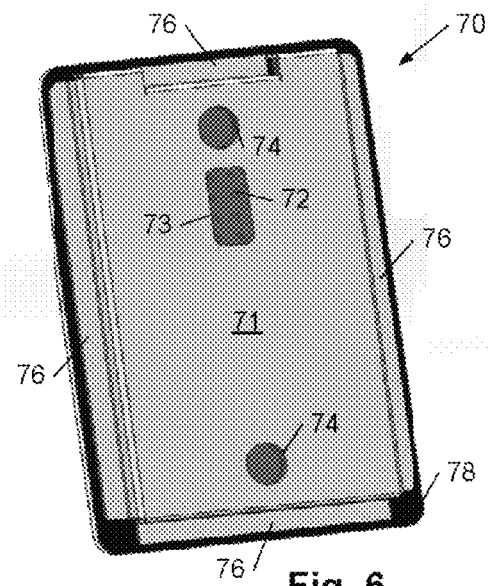
FIG. 6 is a back perspective view of a faceplate of a light control unit used to control illumination of a remote set of lighting fixtures.
Figure 7:
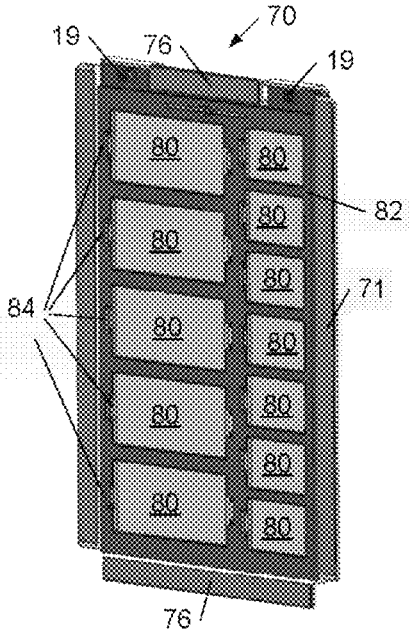
FIG. 7 is a front perspective view of the faceplate depicted in FIG. 6 without its front transparent cover.
Figure 8:
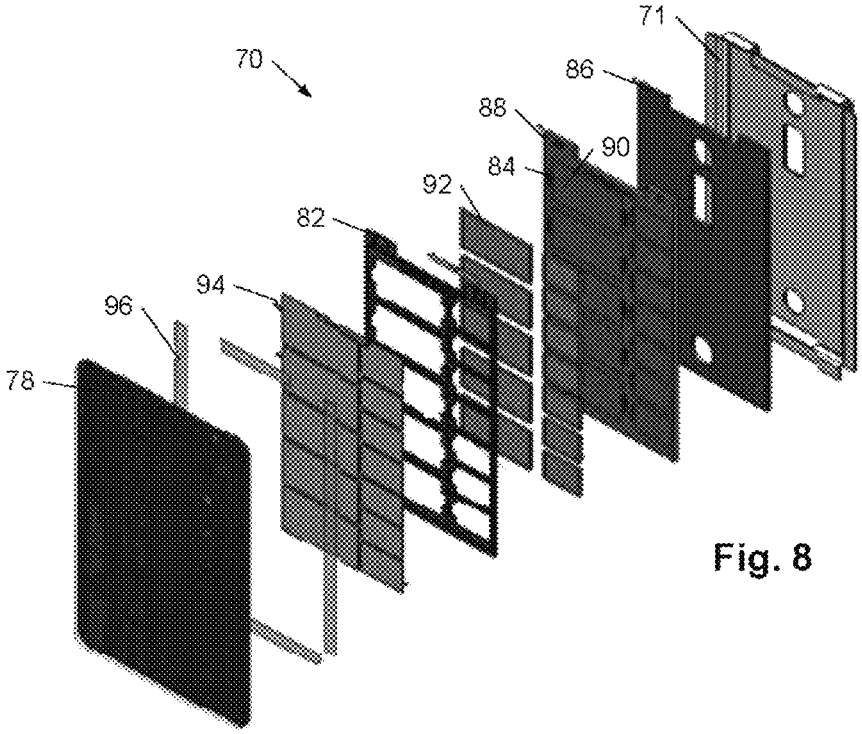
FIG. 8 is an exploded front view drawing of the faceplate depicted in FIG. 6.

FIGS. 4-8 illustrate example structural configurations for a backend base and a faceplate for the light control units and systems described herein. It is noted that alternative configurations of backend bases and faceplates may be considered relative to those depicted in FIGS. 4-8 and, thus, the lighting systems, backend bases and faceplates described herein are not limited to the depictions in FIGS. 4-8. For example, although the shape and size of the backend base depicted in FIGS. 4 and 5 is specific for the backend base to be at least partially nested within an electrical junction box in a wall and the shape and size of the faceplate depicted in FIGS. 6-8 is similar to that of a conventional light switch cover, the shape and size of the backend bases and faceplates considered for the light control units described herein are not so limited. In particular, the backend bases considered herein may be of any size and shape and need not be configured for wall mounting or mounting to any surface for that matter. Furthermore, the faceplates considered herein may be of any size and shape. In addition, the arrangement and/or selection of features on backend bases and faceplates considered herein may differ from those depicted in FIGS. 4-8. As such, although the scale of FIGS. 4-8 may be relevant for size and placement of features of the illustrated backend base and faceplate, other designs of backend bases and faceplates may be considered and, thus, the scale of FIGS. 4-8 does not restrict the scope of backend bases and faceplates described herein.

FIGS. 4 and 5 illustrate front and back perspective views of an example backend base of a light control unit used to control illumination of a remote set of lighting fixtures. As shown in FIG. 4, backend base 50 includes cavity plate 51 having power and data electrical contacts 52 (e.g., pogo pins), alignment markers 54, screw holes 56, magnets 58 and computer service port 59 disposed along the interior surfaces of its cavity. The number, size and placement of such components are exemplary and may differ depending on the design specifications of the light control unit to which backend base 50 is part of. For example, additional magnets may be included in backend base 50, smaller or larger magnets may be used and/or magnets may be additionally or alternatively disposed along the length of cavity plate 51. In general, power and data electrical contacts 52 serve to provide power to a faceplate attached to backend base 50 as well as provide a means of passing data from and, in some cases, to the faceplate. Alignment markers 54 are used to aid in aligning a faceplate to backend base 50 and screw holes 56 provide a means for attaching backend base 50 to a surface, such as a wall, particularly a wall surrounding a standard electrical junction box. Magnets 58 serve to attach a faceplate to backend base 50 and computer service port 59 offers a means to update or change software stored in memory of backend base 50.

As shown in FIG. 4, cavity plate 51 includes a peripheral lip to define a cavity in which its noted components are arranged. The peripheral lip is further sized to accommodate a backend portion of a faceplate, specifically a backend housing, a printed circuit board, and components for providing a lighted display on the front of the faceplate, examples of which are described in more detail below in reference to FIG. 8. In particular embodiments, the peripheral lip of cavity plate 51 may be sized to accommodate a backend portion of a faceplate such that the transparent material comprising the front of the faceplate comes into contact with the front facing edge of the peripheral lip. Other configurations, however, may be considered. For example, backend base 50 may not, in some embodiments, include a cavity plate for supporting the noted components of FIG. 4. Rather, backend base 50 may, in some cases, include a plate without a peripheral edge for supporting the components. In such cases, the back of a faceplate to be coupled to backend base 50 may include a peripheral lip sized to accommodate its backend components as well as the noted components of backend base 50 and to come into contact with the plate comprising such components. In either case, it may be advantageous, in some embodiments, for a faceplate to be relatively thin, particularly if a light control unit is mounted to a wall. As such, the depth of the peripheral lip on cavity plate 51 or alternatively on the back of a faceplate may be relatively shallow, such as less than approximately 10 mm and, in some cases, less than approximately 6 mm. Peripheral lips with larger depths, however, may be considered. The term "approximately" as used herein refers to variations of up to +/−5% of the stated number.

As noted above, FIG. 5 is a back perspective view of backend base 50. As shown, backend base 50 includes hardware and software housing 60 coupled to a back surface of cavity plate 51 between screw holes 56 via screw holes 62. In general, hardware and software housing 60 houses a power supply and a printed circuit board comprising memory and a processor. Other components which may be contained in housing 60 include but are not limited to an AC/DC converter, components enabling WiFi and/or Ethernet functionality and a Power over Ethernet system. Various other components may be included depending on the design specifications of the light control unit to which backend base 50 is part of. In any case, backend base 50 and, more specifically, the memory of backend base 50 may be configured to function with a single faceplate or a plurality of interchangeable faceplates as described above in reference to FIGS. 1-3. As noted above, backend base 50 may be dimensionally configured to be at least partially nested within an electrical junction box in a wall. For such applications, the back surface of hardware and software housing 60 may include push-in wire connector 64 to connect to wires in the electrical junction box. In specific embodiments, hardware and software housing 60 may be dimensionally configured to be wholly nested within an electrical junction box in a wall. In such cases, cavity plate 51 may be dimensionally configured such that it is abutted against a wall surface surrounding the electrical junction box.

FIG. 6 is a back perspective view of an example faceplate of a light control unit used to control illumination of a remote set of lighting fixtures. As shown, faceplate 70 includes cavity plate 71 having flaps 76 adhered to a back surface of transparent front cover 78. In general, cavity plate 71 houses a printed circuit board comprising memory and a processor and further components for providing a lighted display on the front of transparent cover 78, examples of which are described in more detail below in reference to FIG. 8. Various other components may be included depending on the design specifications of the light control unit which faceplate 70 may be a part of. As shown in FIG. 6, cavity plate 71 may include opening 73 exposing electrical contact pads 72 of the printed circuit board in faceplate 70. In addition, cavity plate 71 may include openings 74 to accommodate screws used to attach backend base 50 to a surface. Cavity plate 71 may include various types of materials, including plastics or metal. In some embodiments, it may be advantageous for at least a portion of flaps 76 to include steel or some other magnetic material for joining to magnets 58 of backend base 50. In other embodiments, faceplate 70 may include magnets adhered to portions of flaps 76 for joining to magnets 58 of backend base 50. As noted above, it may be advantageous, in some embodiments, for a faceplate to be relatively thin, particularly if a light control unit is mounted to a wall. An example depth of a faceplate may be less than approximately 15 mm and, in some cases, less than approximately 8 mm. Faceplates with larger depths, however, may be considered.

FIG. 7 is a front perspective view of faceplate 70 without transparent front cover 78. As shown in FIG. 7, faceplate 70 includes light display windows 80 disposed in light guide frame 82 to provide a lighted visual display for faceplate 70. An example of a structural configuration for light display windows 80 is described in more detail below in reference to FIGS. 9 and 10, but other configurations may be considered for providing a lighted visual display. Although FIG. 7 illustrates faceplate 70 with 12 light display windows of two different sizes, the faceplates described herein may include any number, shape and size of light display windows, depending on the design specifications of the light control unit which faceplate 70 may be a part of. As further shown in FIG. 7, light display windows 80 may include one or more light sources 86 for illuminating the windows. The number and type of light sources may vary depending on the design specifications of the light control unit which faceplate 70 may be a part of.

FIG. 8 is an exploded front view drawing of faceplate 70. As shown, a layer-by-layer configuration of faceplate 70 from bottom to top may include cavity plate 71, insulator 86, printed circuit board 88, light guides 92, light guide frame 82, diffuser panels 94, adhesive 96, and transparent front cover 78. Various other components may be included depending on the design specifications of the light control unit which faceplate 70 may be a part of Insulator 86 may include any material exhibiting sufficient insulating properties for printed circuit board 88, including but not limited to foam and rubber. An example of a material which may be suitable for insulator 86 is ethylene propylene diene monomer (EPDM) rubber. In addition to including the memory and processor for faceplate 70, printed circuit board 88 includes a plurality of reflector frames 90 disposed along its upper surface respectively aligned with each of light guides 92. As described in more detail below in reference to FIG. 9, reflector frames 90 are dimensionally configured to contain light guides 92 and include light sources 84 for transmitting light into peripheral edges of the light guides. Although any reflector material may be used for reflector frames 90, reflector materials exhibiting greater than 90% reflectance and, in some cases, greater than 95% reflectance may be preferred in order to optimize the brightness level of the light display window. Light guides 92 may include any type of transparent material. In some embodiments, it may be advantageous for light guides 92 to include a transparent thermoplastic material, such as but not limited to poly(methyl methacrylate), to be able to withstand and not deform in response heat generated by light sources 84.

Light guide frame 82 includes openings arranged and having dimensions sufficient to accommodate reflector frames 90 and their accompanying light sources 84. The thickness of light guide frame 82 may be generally sufficient such that the upper surface of light guide frame 82 is planar with upper surfaces of light guides 92 when faceplate 70 is assembled. Light guide frame 82 may include any material including plastics or metal. In specific embodiments, a substantially inert material may be used, such as but not limited to silicone. Diffuser panels 94 are dimensionally configured to overlay each of light guides 92. Various diffuser materials may be used depending on the design specifications of the light control unit which faceplate 70 may be a part of. Gaussian diffusers may be of particular interest and, in some cases, 40-50 degree Gaussian diffusers may be used. Adhesive 96 may include any adhesive or adhesive material (such as tape) to fixedly secure and seal transparent front cover 78 to flaps 76 of cavity plate 71. In general, transparent front cover 78 may include a transparent material, such as but not limited to tempered glass. In some cases, transparent front cover 78 may include screen printing, such as words, symbols or differentiating borders. In some embodiments, the screen printing may be specific to areas in alignment with light guides 92 such that when the individual light guides are illuminated, the screen printing in the respective area of transparent front cover 78 is illuminated. In some cases, transparent front cover 78 may be printed with a deadfront ink to conceal screen printing on the cover unless it is illuminated.

Figure 9:
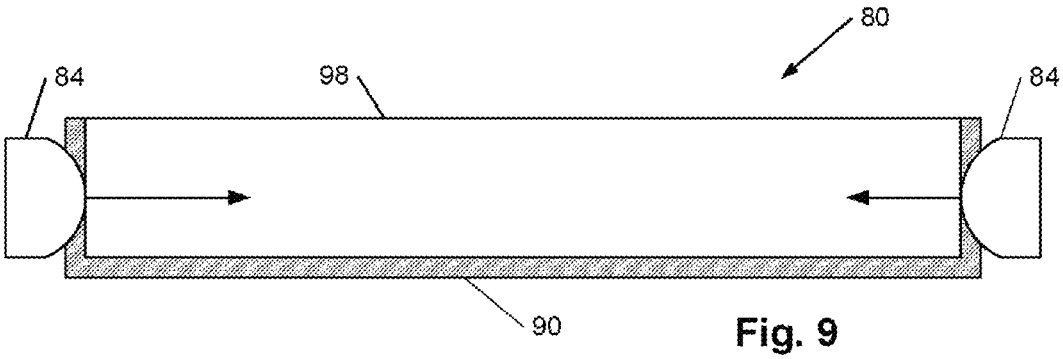
FIG. 9 is a cross-sectional view an individual light guide disposed within a reflector frame which has light sources disposed on opposing ends to transmit light into the light guide.
Figure 10:
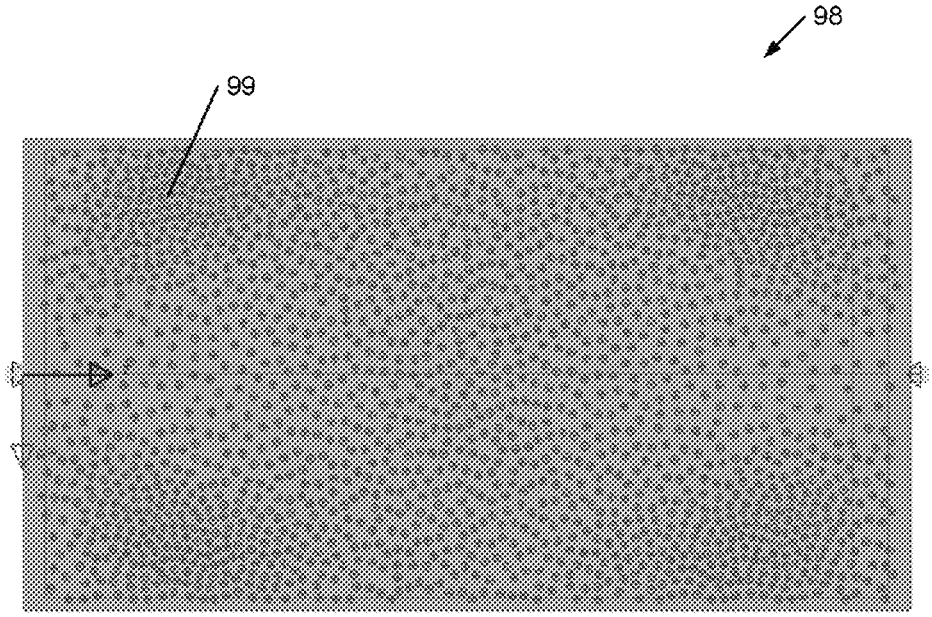
FIG. 10 is a bottom view of an individual light guide having a randomized and optimized array of microspheres on its bottom surface.

Turning to FIGS. 9 and 10, an example of a structural configuration for light display windows 80 is shown. In particular, FIG. 9 illustrates a cross-sectional view of a single light display window 80 without its diffuser material. As shown, single light display window 80 includes an individual light guide 98 disposed within reflector frame 90 which has light sources 84 disposed on opposing ends to transmit light into the light guide. In addition, FIG. 10 depicts a bottom view of individual light guide 98 having an optimized array of microspheres 99 on its bottom surface. In general, light sources 84 may include any type of light source small enough to fit within reflector frame 90, the size of which will generally depend on the design specifications of the light control unit which faceplate 70 may be a part of Light-emitting diodes may be particularly suitable in view of their generally small size, low energy consumption and long lifetime. In any case, light sources 84 may generally be of a smaller size than the thickness of light guide 98 such that a vast majority of the light generated from the light sources is transmitted into the light guide.

As noted above, it may be advantageous for faceplate 70 to be relatively thin and, thus, the thickness of light guide 98 and the corresponding depth of reflector frame 90 may each be a few millimeters or less. In some cases, the thickness of light guide 98 and the corresponding depth of reflector frame 90 may be approximately 1.0 mm. In such cases, an example light source would be a 0.6×0.6 mm light emitting diode, but larger or smaller emitters may be used. As noted above, any number of light sources may be used for individual light display windows 80. In some cases, however, it may be advantageous to limit the number of light sources to one or two to conserve power consumption and fabrication costs. In such cases, it is generally advantageous to dispose the one or two light sources along the shorter dimension edges of the light guide to provide better light distribution through the light guide.

In order to optimize light distribution through light guide 98 (i.e., optimize the uniformity of illuminance from the top surface of light guide 98), light guide 98 may include a micro-textured surface along its bottom surface. In particular, an optimized micro-textured surface may aid in distributing the light through light guide 98 in a more uniform manner. In general, the distribution, size, and shape of the micro-texture will depend on the size and shape of the light guide. An example of a rectangular light guide having a microspherical textures along its bottom surface is shown in FIG. 10, but the light guides described herein should not necessarily be restricted to such a distribution or shape of micro-texturing. As shown in FIG. 10, light guide 98 may include microspherical textures throughout its bottom surface, but have relatively heavier concentrations of microspherical textures at their corners. For the example distribution shown in FIG. 10, it was determined that microspherical textures having a depth of approximately 0.10000 mm and spherical shape of about ⅔ of an upper part of a hemisphere provided sufficiently uniform illuminance through light guide 98. Larger or smaller micro-texturing, however, may be considered. In addition, other shapes of micro-texturing may be considered.

It will be appreciated to those skilled in the art having the benefit of this disclosure that this invention is believed to provide lighting systems and components thereof are provided for controlling illumination of a remote set of lighting fixtures. Further modifications and alternative embodiments of various aspects of the invention will be apparent to those skilled in the art in view of this description. For example, although the aforementioned description emphasizes light control units which are configured for mounting to a wall and particularly being partly nested within an electrical junction box in a wall, the lighting systems, light control units, back-end bases and faceplates described herein are not necessarily so limited. Rather, the light control units described herein may be configured for mounting to any surface or, alternatively, may not be configured for mounting to a surface. Accordingly, this description is to be construed as illustrative only and is for the purpose of teaching those skilled in the art the general manner of carrying out the invention. It is to be understood that the forms of the systems shown and described herein are to be taken as the presently preferred embodiments. Elements and materials may be substituted for those illustrated and described herein, parts and processes may be reversed, and certain features of the systems may be utilized independently, all as would be apparent to one skilled in the art after having the benefit of this disclosure. Changes may be made in the elements described herein without departing from the spirit and scope of the invention as described in the following claims.

What is claimed is:

1. A system, comprising:

a base;

a faceplate detachably mounted to the base such that power and data electrical contacts of the faceplate are coupled to respective power and data electrical contacts of the base, wherein the faceplate comprises a user input interface; and a remote set of light fixtures communicably coupled to the base;

wherein the base and the faceplate each comprise memory and a processor, and wherein the respective memories of the base and the faceplate each comprise respective processor-executable program instructions to facilitate electrical communication between the base and the faceplate to independently control each of the remote set of light fixtures based on input to the user input interface.

2. The system of claim 1, wherein the memory of either the base or the faceplate comprises processor executable program instructions to auto-configure hardware and/or software of the faceplate or the base, respectively.

3. The system of claim 1, wherein the faceplate comprises an electronic identification tag, and wherein the memory of the base comprises processor-executable program instructions to detect the electronic identification tag.

4. The system of claim 1, wherein the faceplate further comprises one or more sensors, and wherein the respective processor-executable program instructions to facilitate electrical communication between the base and the faceplate to independently control each of the remote set of light fixtures is further based on input to the one or more sensors.

5. The system of claim 4, wherein the one or more sensors are selected from a group consisting of proximity sensors, motion sensors, light sensors and temperature sensors.

6. The system of claim 1, wherein the memory of the base and/or the faceplate comprises default settings for each of the remote set of light fixtures, and wherein the respective processor-executable program instructions to facilitate electrical communication between the base and the faceplate to independently control each of the remote set of light fixtures is further based on the default settings.

7. The system of claim 1, wherein the user input interface comprises a lighted visual display.

8. The system of claim 1, wherein the base is mounted to a wall.

9. The system of claim 1, wherein the base is at least partially nested within an electrical junction box in a wall.

10. The system of claim 1, wherein the faceplate is detachably mounted to the base via magnets disposed on each of the base and the faceplate.

11. The system of claim 1, wherein the base is wired to the remote set of light fixtures.

12. The system of claim 1, wherein the base is wirelessly connected to the remote set of light fixtures.

13. A base of a light control system, wherein the base comprises:

power and data electrical contacts arranged to respectively couple to power and data electrical contacts of a plurality of different faceplates which when individually connected to the base collect and send information to the base to control one or more remote light fixtures of the light control system;

a processor; and memory comprising program instructions executable by the processor to individually auto-configure differing hardware and/or software of the plurality of different faceplates when they are respectively coupled to the base.

14. The base of claim 13, further comprising an attachment means for individually securing the base to each of the plurality of different faceplates.

15. The base of claim 13, wherein the memory further comprises default settings for each of the one or more remote light fixtures of the light control system.

16. The base of claim 13, further comprising a computer service port coupled to the memory.

17. The base of claim 13, further comprising WiFi functionality.

18. The base of claim 13, further comprising Ethernet functionality.

19. The base of claim 13, further comprising a Power over Ethernet system.

20. A detachable faceplate for a light control system, wherein the faceplate comprises:

a user input interface disposed on a first side of the detachable faceplate;

power and data electrical contacts disposed on a second side of the detachable faceplate which opposes the first side;

an electronic identification tag;

a processor; and memory comprising program instructions executable by the processor to auto-configure hardware and/or software of a base of the light control system.

21. The detachable faceplate of claim 20, further comprising one or more sensors disposed to collect ambient information from the first side of the faceplate, wherein the memory further comprises program instructions executable by the processor to pass information from the one or more sensors to the data electrical contacts.

22. The detachable faceplate of claim 21, wherein the one or more sensors are selected from a group consisting of proximity sensors, motion sensors, light sensors and temperature sensors.

23. The detachable faceplate of claim 20, further comprising an attachment means for securing its second side to the base of the light control system.

24. The detachable faceplate of claim 20, further comprising a lighted visual display.

25. The detachable faceplate of claim 20, wherein the memory further comprises default settings for each of a remote set of light fixtures of the light control system.

* * * * *